US011196202B2

(12) United States Patent
Hua et al.

(10) Patent No.: US 11,196,202 B2
(45) Date of Patent: Dec. 7, 2021

(54) ELECTRICAL CONNECTOR AND ELECTRONIC DEVICE

(71) Applicant: Tyco Electronics (Shanghai) Co. Ltd., Shanghai (CN)

(72) Inventors: Li Hua, Shanghai (CN); He Jiayong, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 7 days.

(21) Appl. No.: 16/893,945

(22) Filed: Jun. 5, 2020

(65) Prior Publication Data

US 2020/0388946 A1 Dec. 10, 2020

(30) Foreign Application Priority Data

Jun. 6, 2019 (CN) ..... 201910496006.5
Nov. 7, 2019 (CN) ..... 201911093589.3

(51) Int. Cl.
*H01R 13/24* (2006.01)
*H01R 13/62* (2006.01)
*H01R 13/502* (2006.01)
*H01R 12/71* (2011.01)

(52) U.S. Cl.
CPC ..... *H01R 13/2407* (2013.01); *H01R 12/71* (2013.01); *H01R 13/502* (2013.01); *H01R 13/62* (2013.01)

(58) Field of Classification Search
CPC ..... H01R 13/6315; H01R 13/187; H01R 13/2407; H01R 13/62; H01R 13/502; H01R 12/71
USPC ..... 439/247, 248, 252, 843, 851
See application file for complete search history.

(56) References Cited

U.S. PATENT DOCUMENTS 5,516,303 A * 5/1996 Yohn ..... H01R 13/6315 439/248
6,699,054 B1 * 3/2004 Critelli ..... H01R 13/6315 439/248
2016/0172770 A1 * 6/2016 Ando ..... H01R 13/193 439/838
2018/0358748 A1 * 12/2018 Yamanashi ..... H01R 24/62
2019/0027865 A1 * 1/2019 Sakaue ..... H01R 13/20

* cited by examiner

*Primary Examiner* — Gary F Paumen
(74) *Attorney, Agent, or Firm* — Barley Snyder

(57) ABSTRACT

An electrical connector adapted to be electrically connected with a mating terminal includes an outer housing, an inner housing, and an elastic terminal. The outer housing includes an outer cylindrical body, and an upper blocking disc and a lower blocking disc radially extending inwardly from opposite ends of the outer cylindrical body, the upper blocking disc has an outer through hole. The inner housing includes an inner cylindrical body and a mounting portion surrounding an outer periphery of the inner cylindrical body. The inner housing is formed with an inner through hole. The mounting portion is movably mounted in a space defined by the outer cylindrical body, the upper blocking disc, and the lower blocking disc. The elastic terminal is mounted within the inner cylindrical body and adapted to be electrically connected with the mating terminal inserted into the inner cylindrical body through the outer through hole and the inner through hole.

24 Claims, 14 Drawing Sheets

ELECTRICAL CONNECTOR AND ELECTRONIC DEVICE

CROSS-REFERENCE TO RELATED APPLICATIONS

This application claims the benefit of the filing date under 35 U.S.C. § 119(a)-(d) of Chinese Patent Application No. 201910496006.5, filed on Jun. 6, 2019, and Chinese Patent Application No. 201911093589.3, filed on Nov. 7, 2019.

FIELD OF THE INVENTION

The present invention relates to an electrical connector and, more particularly, to an electrical connector having an elastic terminal.

BACKGROUND

A plug-type mating terminal is commonly inserted into a receptacle connector. The mating terminal may be inserted into an electrical connector to be electrically connected with a connection terminal within the electrical connector. The electrical connector has a generally cylindrical outer profile and is adapted to be fixed and electrically connected to a circuit board so as to be electrically connected to a wire of the mating terminal and the circuit board.

During operation, interference such as a vibration from external factors may result in floating of the mating terminal relative to the electrical connector. Such floating may cause the electrical connection between the mating terminal and the electrical connector to fail and sometimes even damage the mating terminal or/and the electrical connector.

SUMMARY

An electrical connector adapted to be electrically connected with a mating terminal includes an outer housing, an inner housing, and an elastic terminal. The outer housing includes an outer cylindrical body, and an upper blocking disc and a lower blocking disc radially extending inwardly from opposite ends of the outer cylindrical body, the upper blocking disc has an outer through hole. The inner housing includes an inner cylindrical body and a mounting portion surrounding an outer periphery of the inner cylindrical body. The inner housing is formed with an inner through hole. The mounting portion is movably mounted in a space defined by the outer cylindrical body, the upper blocking disc, and the lower blocking disc. The elastic terminal is mounted within the inner cylindrical body and adapted to be electrically connected with the mating terminal inserted into the inner cylindrical body through the outer through hole and the inner through hole.

BRIEF DESCRIPTION OF THE DRAWINGS

The invention will now be described by way of example with reference to the accompanying Figures, of which.

DETAILED DESCRIPTION OF THE EMBODIMENTS

Figure 1:
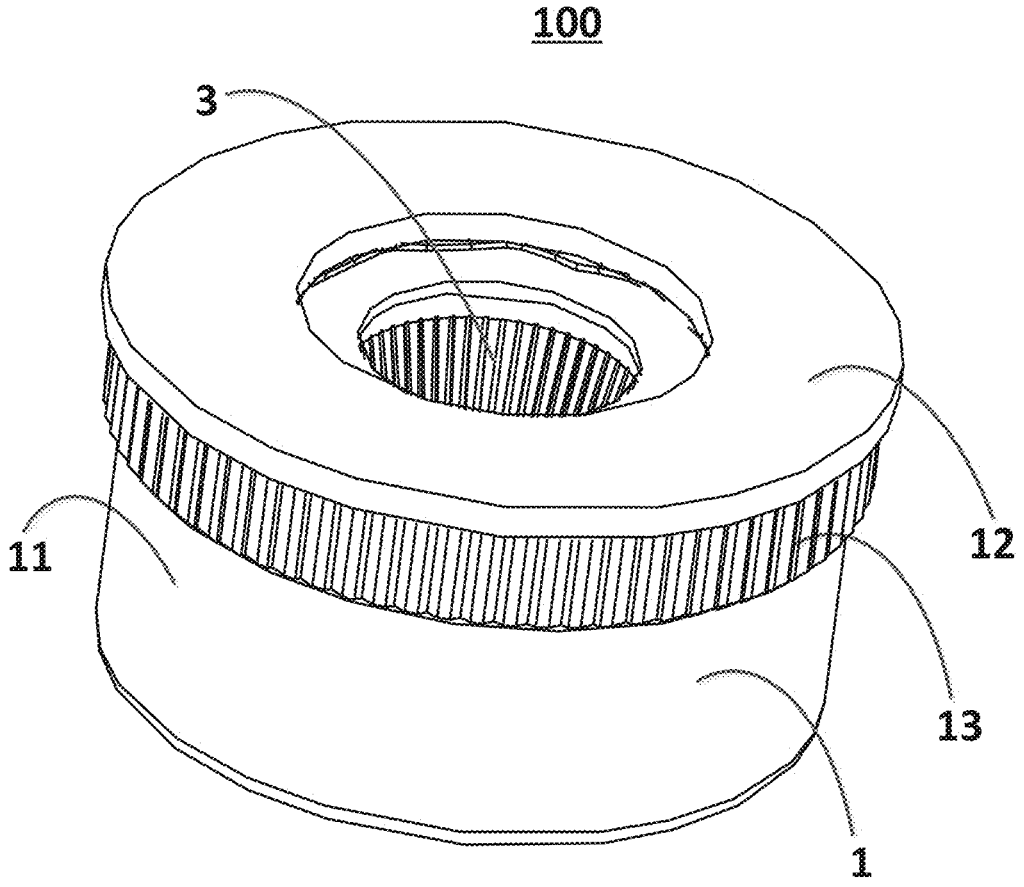
FIG. 1 is a perspective view of an electrical connector according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
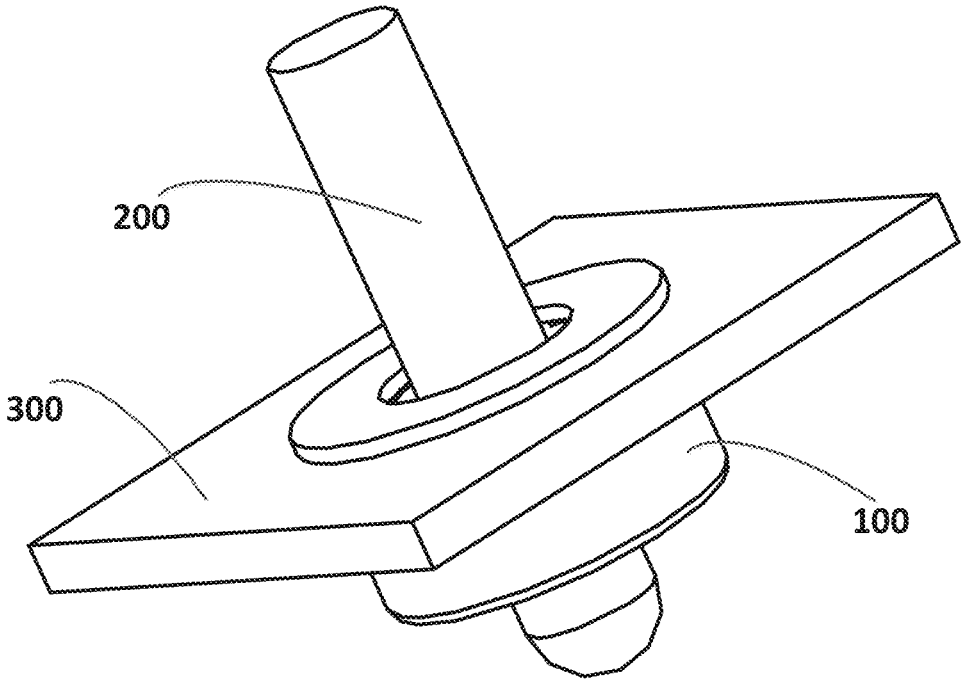
FIG. 2 is a perspective view of the electrical connector of FIG. 1 connected to a mating terminal.
Figure 3:
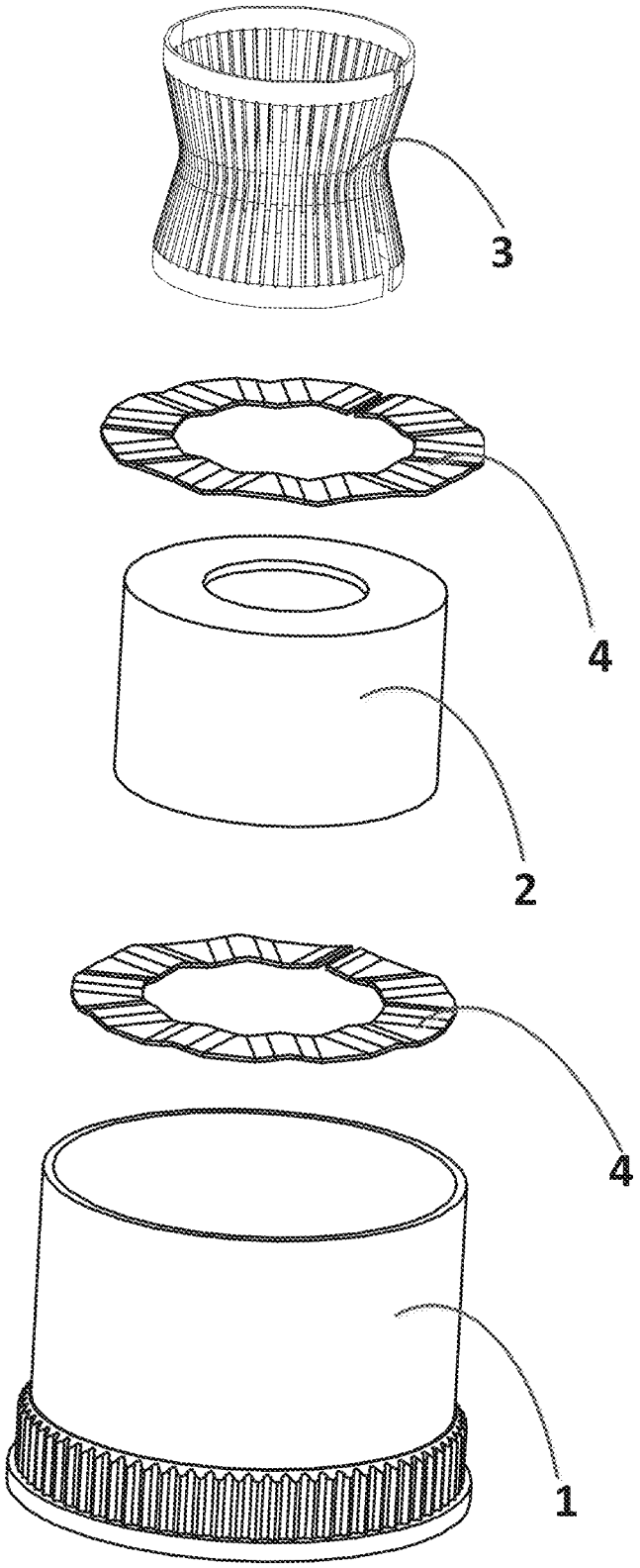
FIG. 3 is an exploded perspective view of the electrical connector of FIG. 1.

An electrical connector 100 according to an exemplary embodiment, as shown in FIGS. 1-3, is adapted to be electrically connected to a plug-type mating terminal 200 and comprises an outer housing 1, an inner housing 2 and an elastic terminal 3.

As shown in FIGS. 1-4, the outer housing 1 has an outer cylindrical body 11, and an upper blocking disc 12 and a lower blocking disc 14 radially extending inwardly from both ends of the outer cylindrical body 11. The upper blocking disc 12 has an outer through hole 15.

Figure 4:
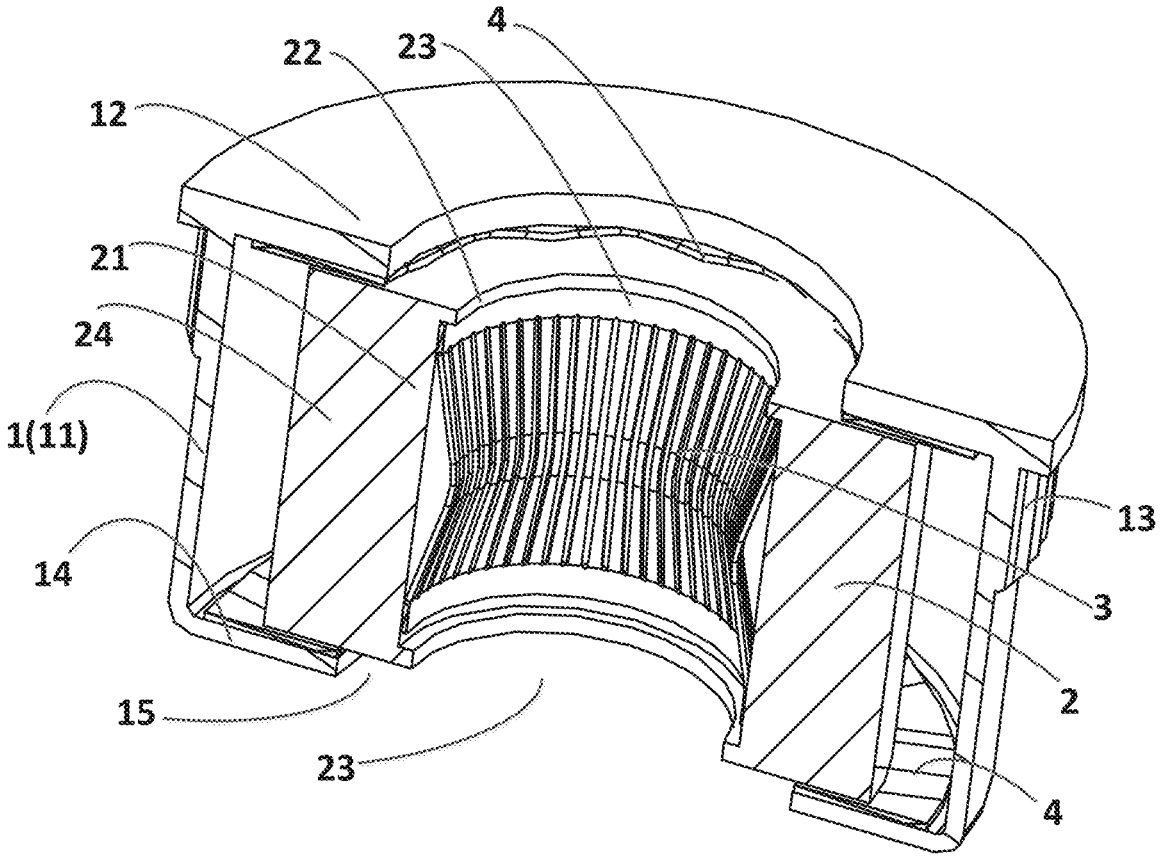
FIG. 4 is a sectional perspective view of the electrical connector of FIG. 1.

The inner housing 2, as shown in FIG. 4, has an inner cylindrical body 21 and a mounting portion 24 surrounding an outer periphery of the inner cylindrical body 21 and integrally formed at the outer periphery of the inner cylindrical body 21. The mounting portion 24 is movably mounted in a space defined by the outer cylindrical body 11, the upper blocking disc 12, and the lower blocking disc 14. The inner housing 2 is formed with an inner through hole 23.

The elastic terminal 3, as shown in FIG. 4, is mounted within the inner cylindrical body 21 and adapted to be electrically connected with the mating terminal 200 inserted into the inner cylindrical body 21 through the outer through hole 15 of the outer housing 1.

The electrical connector 100 of the embodiment of the disclosure, as shown in FIGS. 3 and 4, further comprises an elastic mechanism 4 mounted between the outer housing 1 and the inner housing 2. The inner housing 2 is movable relative to the outer housing 1 against an elastic force of the elastic mechanism 4. The inner housing 2 is movable relative to the outer housing 1 against the elastic force of the elastic mechanism 4 to allow the mating terminal 200 mounted in the elastic terminal 3 to be movable relative to the outer housing 1 together with the elastic terminal 3, and it is thus possible to achieve a floating electrical connection of the mating terminal 200 with the electrical connector 100.

As shown in FIGS. 1-6, in an exemplary embodiment, the lower blocking disc 14 is formed by being bent radially inwardly after the inner housing 2 and the elastic mechanism 4 are assembled into the outer housing 1. The lower blocking disc 14 is shown prior to bending in FIG. 5 and is shown after bending in FIG. 6. In this way, a holding force of the lower blocking disc 14 to the inner housing 2 is increased, thereby simplifying an overall structure of the electrical connector 100. In addition, the upper blocking disc 12 and the outer cylindrical body 11 may be manufactured through a punching process simultaneously, for example.

In an exemplary embodiment, the electrical connector 100 is a circular connector and has a generally cylindrical outer profile. The outer housing 1, the elastic terminal 3, the inner housing 2, and the elastic mechanism 4 are all made of an electrically conductive material such as copper such that the mating terminal 200 is in electrical communication with the outer housing 1. In this way, the outer housing 1 may be directly electrically connected onto a circuit board 300 to achieve an electrical connection of the mating terminal 200 with the circuit board 300, as shown in FIG. 2.

In an exemplary embodiment, the mounting portion 24 has the same height as that of the inner cylindrical body 21. That is, as shown in FIG. 4, a sidewall of the inner housing 2 has the same thickness throughout the entire height, the mounting portion 24 is integrally formed outside the inner cylindrical body 21 throughout the entire height of the inner cylindrical body 21, and the outer housing 1 has a height greater than the maximum height of the inner housing 2.

Figure 5:
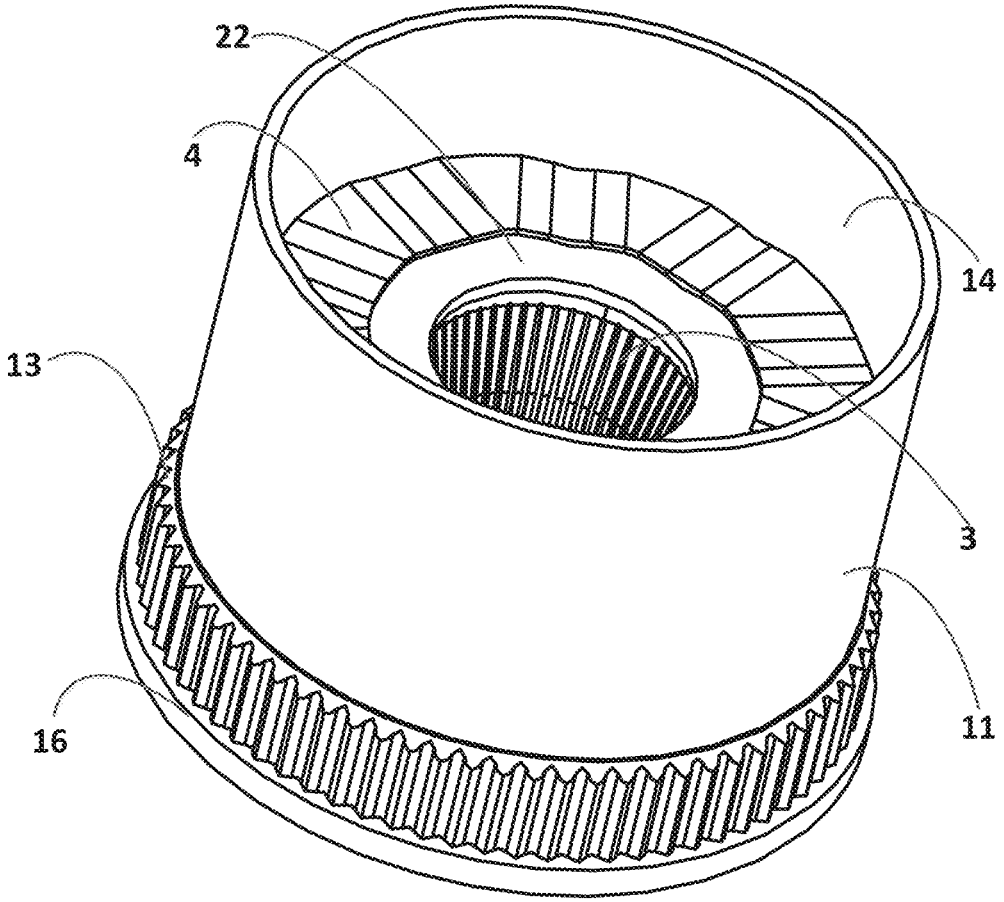
FIG. 5 is a perspective view of the electrical connector of FIG. 1 in which a lower blocking disc of an outer housing has not yet been bent.
Figure 6:
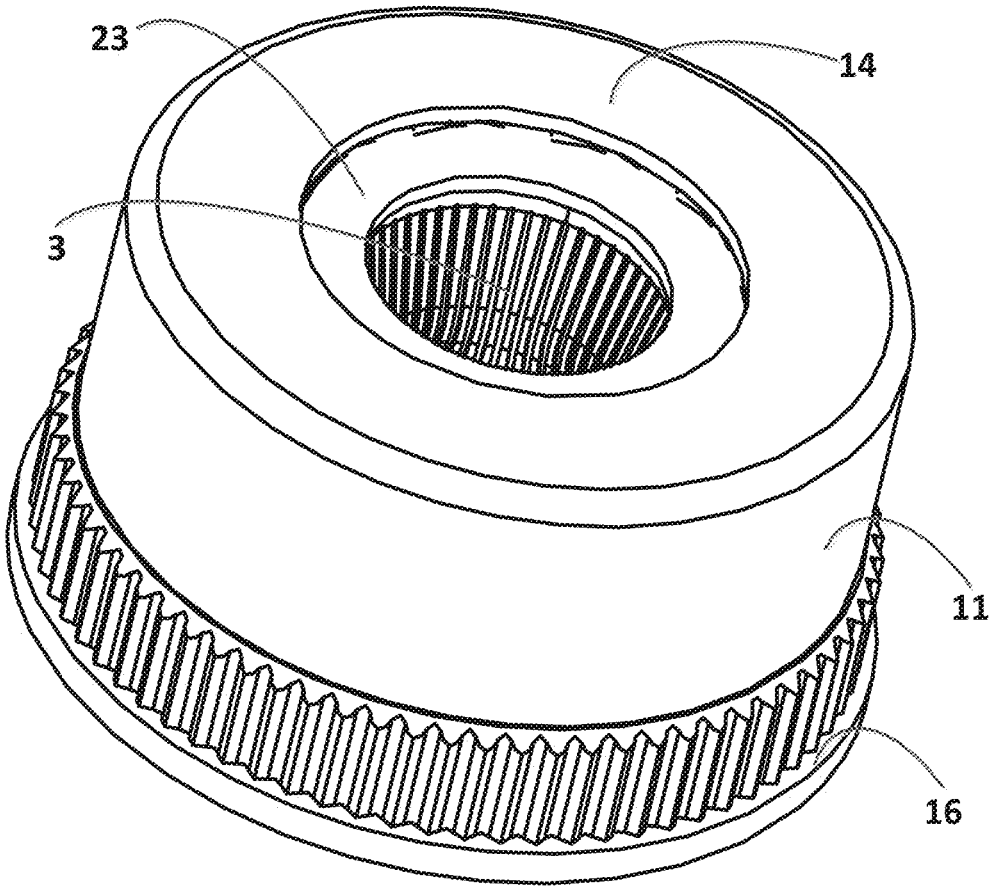
FIG. 6 is a perspective view of the electrical connector of FIG. 1 in which the lower blocking disc has been bent.

The upper blocking disc 12 further extends radially outwardly to form a flange portion 16, as shown in FIGS. 5 and 6. A portion of the outer cylindrical body 11 adjacent to the flange portion 16 is formed as a widened portion protruding radially outwardly. The circuit board 300 with a mounting hole or a copper terminal strip may be mounted on the widened portion through a soldering or crimping process, and is abutted against the flange portion 16, thereby firmly mounting the electrical connector 100 on the circuit board. Further, the widened portion is formed with serrations 13 to further securely mount the electrical connector 100 on the circuit board.

In an exemplary embodiment shown in FIG. 4, the elastic mechanisms 4 are arranged between the upper blocking disk 12 and the lower blocking disk 14 and both ends of the inner housing 2, respectively. The inner housing 2 is movable relative to the outer housing 1 against the elastic force of the elastic mechanisms 4 in an axial direction. After an axial external force applied to the inner housing 2 disappears, the elastic mechanisms 4 may drive the inner housing 2 to return to an original position. The elastic mechanisms 4 each are formed as an annular elastic piece provided as a wave shape in a circumferential direction to increase elasticity of the elastic mechanisms 4.

As shown in FIGS. 3-7, in the illustrated embodiment, the inner cylindrical body 2 has blocking flanges 22 extending radially inwardly at both ends thereof. The blocking flanges 22 are annular and define the inner through hole 23. The elastic terminal 3 comprises an elastic cylindrical body 31 formed by winding a single metal sheet such as a copper sheet. Both ends 32 of the elastic cylindrical body are confined within the inner cylindrical body 21 by the blocking flanges 22 of the inner cylindrical body 21 of the inner housing 2 so that the elastic mechanisms 4 cannot be disengaged from the inner cylindrical body 2.

Figure 7:
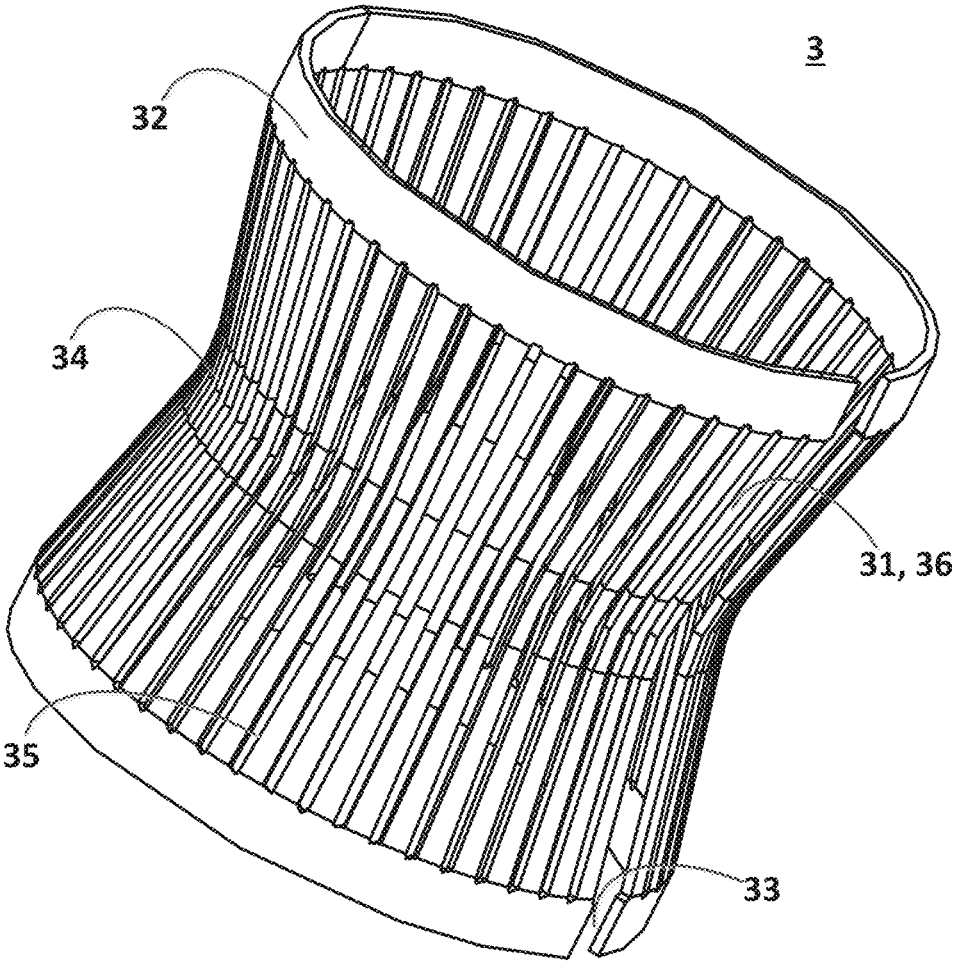
FIG. 7 is a perspective view of an elastic terminal of the electrical connector of FIG. 1.
Figure 8:
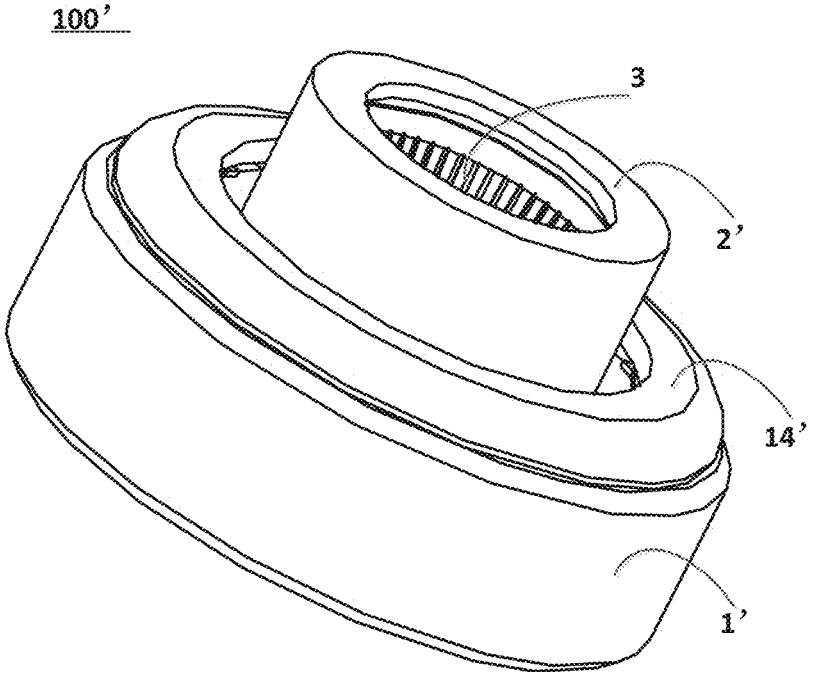
FIG. 8 is a perspective view of an electrical connector according to another embodiment.

In an exemplary embodiment shown in FIG. 7, a contact portion 34 is provided between both ends of the elastic terminal 3 and protrudes radially inwardly. The contact portion 34 is formed in the entire circumferential direction of the elastic terminal 3. In a case where the mating terminal 200 is inserted into the elastic terminal 3 in an axial direction as shown in FIG. 2, the contact portion 34 is compressed and elastically contracted to be elastically brought into contact with the inserted mating terminal 200, thereby increasing reliability of the electrical connection between the elastic terminal 3 and the mating terminal 200.

In an exemplary embodiment, the elastic terminal 3 has a maximum outer diameter larger than an inner diameter of the inner cylindrical body 21 when not mounted within the inner cylindrical body 21. In this way, the elastic terminal 3 is elastically contracted radially when mounted in the inner housing 2, so that the both ends 32 of the elastic terminal 3 are elastically abutted against the inner wall of the inner cylindrical body 2. Further, the elastic terminal 3 is reliably held in the inner housing 2 due to the blocking of the blocking flange 22, as shown in FIG. 4.

In an exemplary embodiment shown in FIG. 7, a plurality of elastic sheets 36 extending in the axial direction are arranged between the both ends 32 of the elastic cylindrical body 31, and a slit 35 is formed between two adjacent elastic sheets 36. During manufacturing the elastic terminal 3, a metal sheet may be spread flatly. Then, the metal sheet is punched by a punching tool to form a plurality of parallel elastic sheets 36. Thereafter, the metal sheet is punched at a substantially middle portion thereof to form a bent contact portion 34. Then, the metal sheet is rolled up to form the elastic terminal 3 shown in FIG. 7.

In the embodiment shown in FIG. 7, there is a gap 33 between two opposite side edges of the elastic cylindrical body 31 to allow the elastic terminal 3 to radially contract inwardly when placed in the inner cylindrical body 2. In an alternative embodiment, the two opposite side edges of the elastic cylinder 31 may be overlapped with each other.

In an embodiment, the inner through hole 23 has an inner diameter smaller than that of the outer through hole 15, and the inner through hole 23 is located within the outer through hole 15 when the inner cylindrical body 21 is maximally floated relative to the outer housing 1 in a radial direction. In this way, even when the inner cylindrical body 21 is maximally floated relative to the outer housing 1 in the radial direction, it is impossible to prevent the mating terminal 200 from being smoothly inserted into the electrical connector 100.

In an embodiment, the outer through hole 15 and the inner through hole 23 are provided respectively at both ends of the outer housing 1 and the inner housing 2 to allow the mating terminal 200 to be inserted into and pass through the electrical connector 100 in the axial direction, as shown in FIG. 2.

In an exemplary embodiment, a resilient mechanism (not shown) is provided between the mounting portion 24 of the inner cylindrical body 2 and the outer cylindrical body 1, and the inner housing 2 is movable relative to the outer housing 1 against an elastic force of the resilient mechanism in the radial direction. After a radial external force applied to the inner housing 2 disappears, the elastic mechanism 4 may drive the inner housing 2 to return to its original position. For example, the resilient mechanism may be formed as an elastic member similar to that shown in FIG. 7.

An electrical connector 100' according to another embodiment is shown in FIGS. 8-13. The electrical connector 100' is adapted to be electrically connected with a plug-type mating terminal 200 and comprises an outer housing 1', an inner housing 2', and an elastic terminal 3. The outer housing 1' has an outer cylindrical body 11', and an upper blocking disc 12 and a lower blocking disc 14' radially extending inwardly from both ends of the outer cylindrical body 11'. The upper blocking disc 12 is provided with an outer through hole 15. The inner housing 2' has an inner cylindrical body 21' and a mounting portion 24 surrounding an outer periphery of the inner cylindrical body 21' and integrally formed at the outer periphery of the inner cylindrical body 21'. The mounting portion 24 is movably mounted in a space defined by the outer cylindrical body 11', the upper blocking disc 12, and the lower blocking disc 14'. The inner housing 2' is formed with an inner through hole 23. The elastic terminal 3 is mounted within the inner cylindrical body 21' and adapted to be electrically connected with the mating terminal 200 inserted into the inner cylindrical body 21' through the outer through hole 15 of the outer housing 1'.

The electrical connector 100' of the embodiment in FIGS. 8-13 further comprises an elastic mechanism 4 mounted between the outer housing 1' and the inner housing 2', The inner housing 2' is movable relative to the outer housing 1' against an elastic force of the elastic mechanism 4. Since the inner housing 2' is movable relative to the outer housing 1' against the elastic force of the elastic mechanism 4 to allow the mating terminal 200 mounted in the elastic terminal 3 to be movable relative to the outer housing 1' together with the elastic terminal 3, it is possible to achieve a floating electrical connection of the mating terminal 200 with the electrical connector 100.

As shown in FIGS. 8-13, in an exemplary embodiment, the lower blocking disc 14' is formed by being bent radially inwardly after the mounting portion 24 of the inner housing 2' and the elastic mechanism 4 are assembled into the outer housing 1'. In this way, a holding force of the lower blocking disc 14' to the inner housing 2' is increased, thereby simplifying an overall structure of the electrical connector 100'. In addition, the upper blocking disc 12 and the outer cylindrical body 11' may be manufactured through a punching process at one time, for example.

In an exemplary embodiment, the electrical connector 100' comprises a circular connector and has a generally cylindrical outer profile. The outer housing 1', the elastic terminal 3, the inner housing 2' and the elastic mechanism 4 are all made of a conductive material such as copper, so that the mating terminal 200 is in electrical communication with the outer housing F. In this way, the outer housing may be directly electrically connected onto a circuit board 300 to achieve an electrical connection of the mating terminal 200 with the circuit board 300.

It should be understood that the elastic terminal 3 and elastic mechanism 4 of the electrical connector 100' illustrated in FIGS. 8-13 may employ the elastic terminals 3 and the elastic mechanisms 4 of the electrical connector illustrated in FIGS. 1-7.

Figure 9:
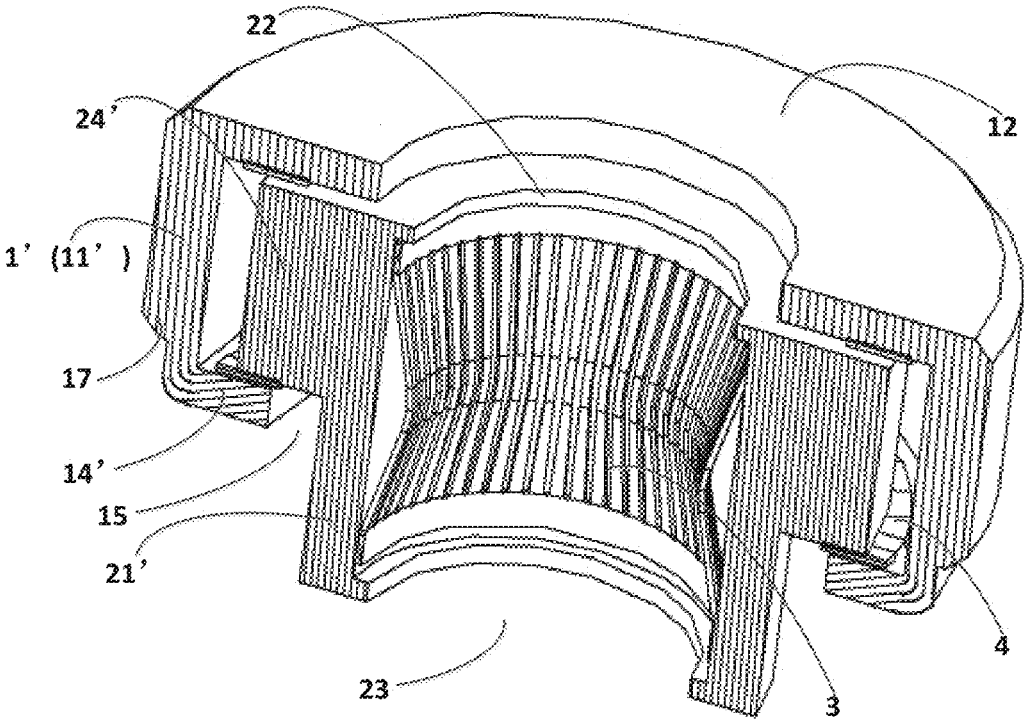
FIG. 9 is a sectional perspective view of the electrical connector of FIG. 8.
Figure 12:
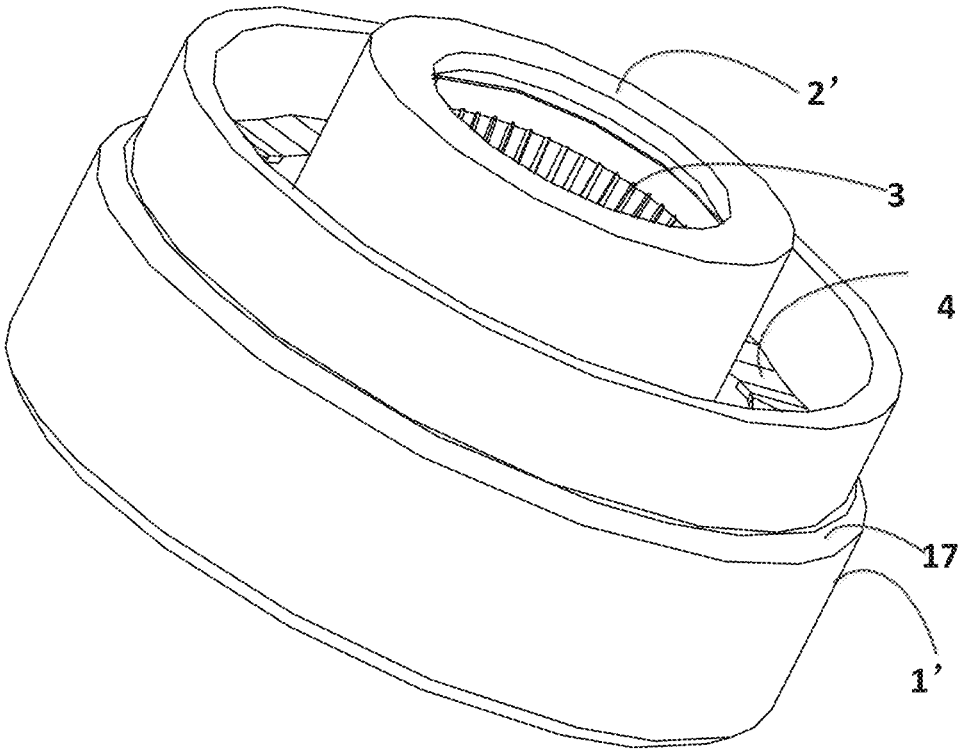
FIG. 12 is a perspective view of the electrical connector of FIG. 8 in which a lower blocking disc of an outer housing has not yet been bent.
Figure 13:
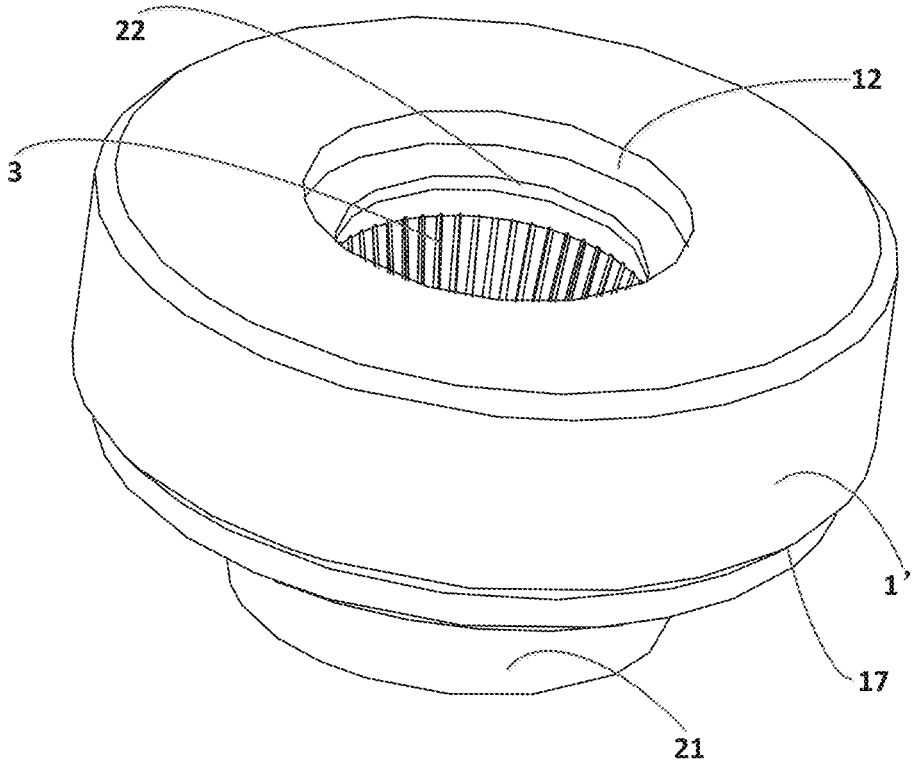
FIG. 13 is a perspective view of the electrical connector of FIG. 8 in which the lower blocking disc has been bent.

In an exemplary embodiment, the mounting portion 24' has a height less than that of the inner cylindrical body 21' such that at least a portion of the inner cylindrical body 21' protrudes from at least one of the upper and lower blocking discs 12, 14' of the outer housing 1', as shown in FIGS. 9, 12, and 13. In an exemplary embodiment, the mounting portion 24' is formed adjacent to the upper blocking disc 12, and at least a portion of the inner cylindrical body 21' extends from the lower blocking disc 14'. That is, as shown in FIG. 9, the mounting portion 24' protrudes radially outwardly at an end of the inner cylindrical body 21' adjacent to the lower blocking disc 14' to form an annular flange. In an alternative embodiment, the mounting portion 24' may be composed of a plurality of protrusions located in the same height range.

Figure 10:
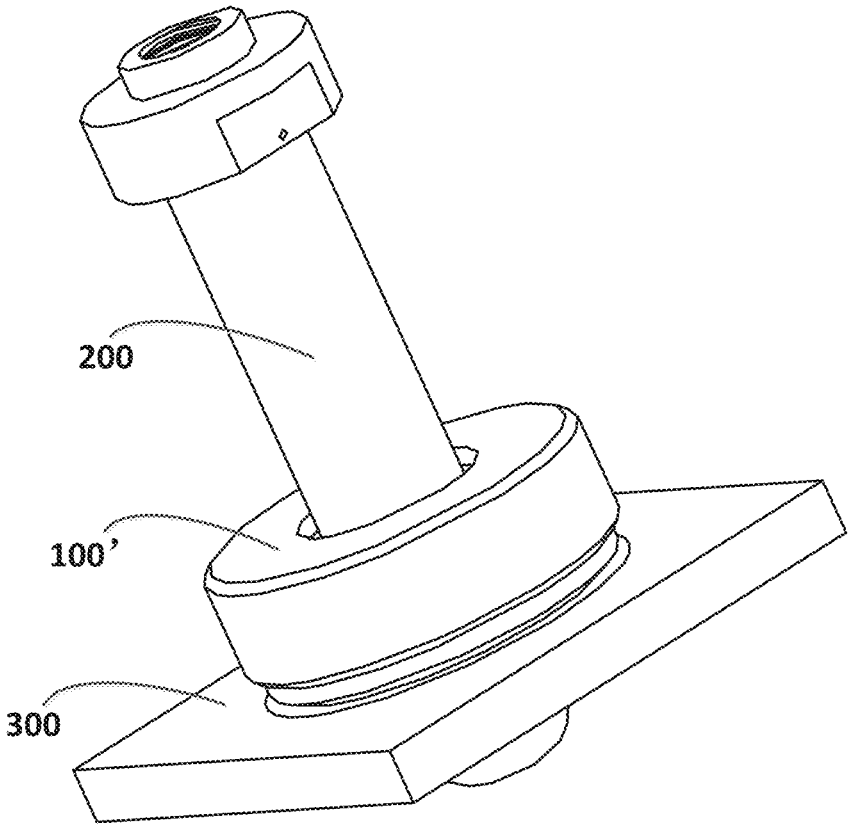
FIG. 10 is a perspective view of the electrical connector of FIG. 8 connected with a mating terminal.
Figure 11:
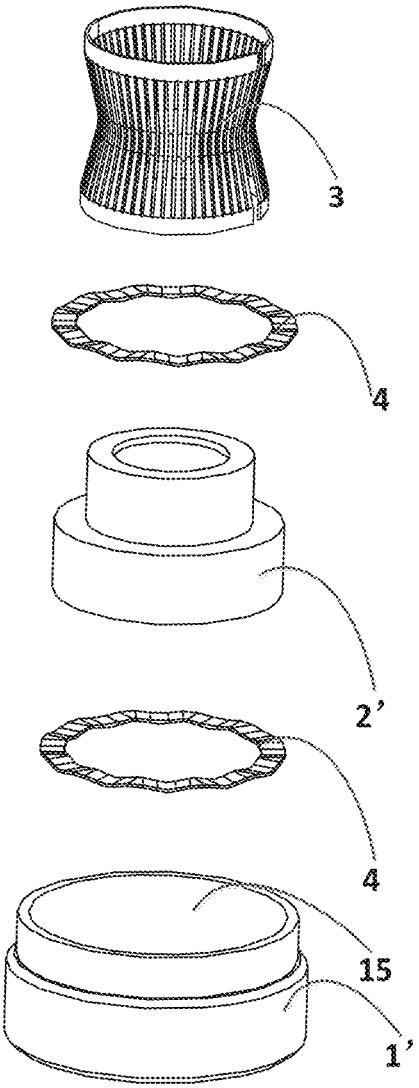
FIG. 11 is an exploded perspective view of the electrical connector of FIG. 8.

In an exemplary embodiment, a stepped portion 17 is formed near a lower end of the outer cylindrical body 1', as shown in FIGS. 9, 12, and 13. The stepped portion 17 is adapted to mount the outer cylindrical body 1' into a mounting hole of the circuit board 300, as shown in FIG. 10, The circuit board 300 with the mounting hole or a copper terminal strip may be mounted on the stepped portion 17 through a soldering or crimping process, and is abutted against a portion of the stepped portion 17 extending radially, thereby firmly mounting the electrical connector 100' on the circuit board 300. Further, the stepped portion 17 has an axially extending portion formed with serrations to further securely mount the electrical connector 100' on the circuit board. In this way, the inner cylindrical body 21' of the electrical connector 100' passes through the circuit board 300. Thus, an overall height of an electronic device comprising the circuit board 300 and the electrical connector 100' may be reduced.

In an exemplary embodiment, the inner through hole 23 has an inner diameter smaller than that of the outer through hole 15, and the inner through hole 23 is located within the outer through hole 15 when the inner cylindrical body 21' is maximally floated relative to the outer housing in a radial direction. In this way, even when the inner cylindrical body 21' is maximally floated relative to the outer housing 1' in the radial direction, it is impossible to prevent the mating terminal 200 from being smoothly inserted into the electrical connector 100'.

In an exemplary embodiment, the outer through hole 15 and the inner through hole 23 are provided respectively at both ends of the outer housing 1' and the inner housing 2' to allow the mating terminal 200 to be inserted into and pass through the electrical connector 100' in the axial direction, as shown in FIG. 10.

Figure 14:
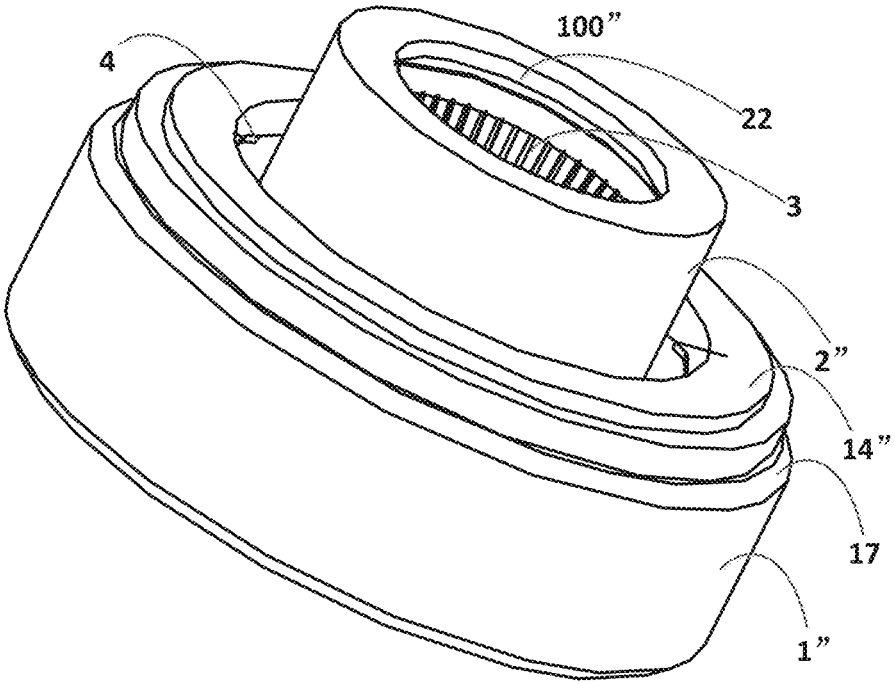
FIG. 14 is a perspective view of an electrical connector according to another embodiment.
Figure 15:
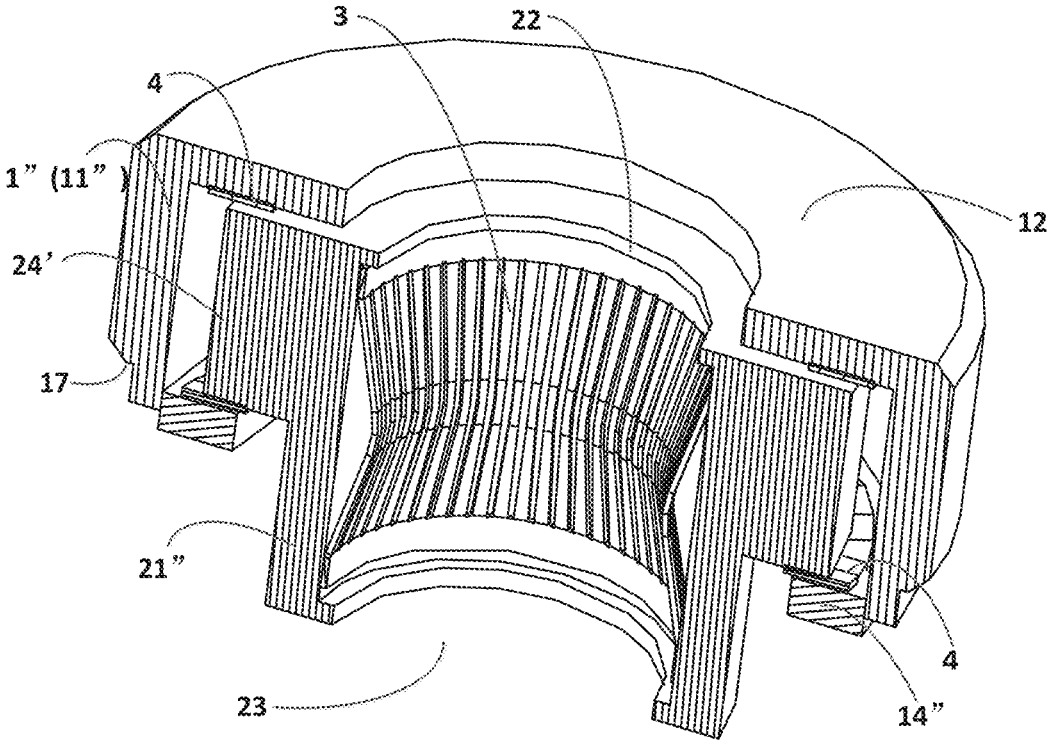
FIG. 15 is a sectional perspective view of the electrical connector of FIG. 14.
Figure 16:
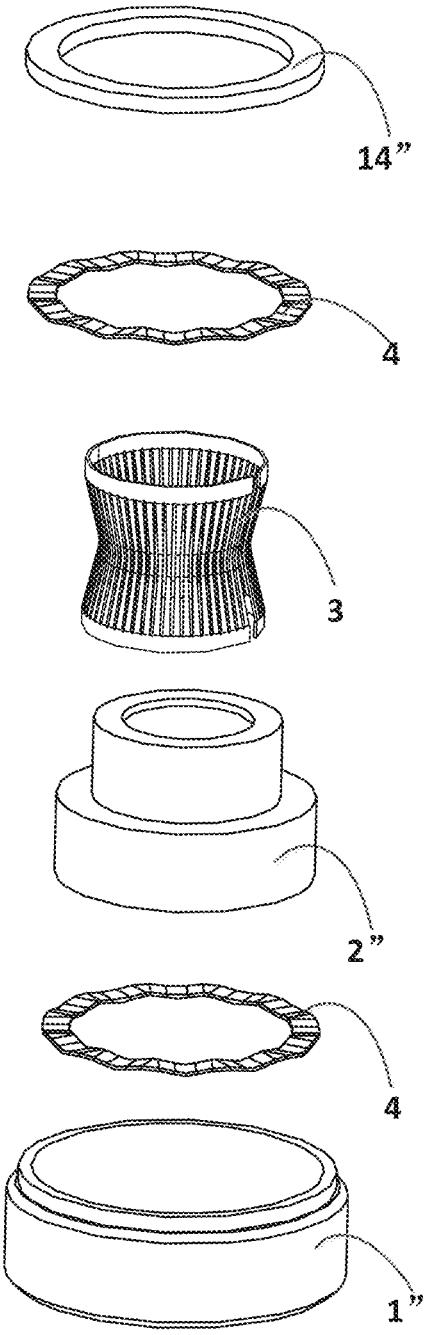
FIG. 16 is an exploded perspective view of the electrical connector of FIG. 15.

An electrical connector 100" according to another embodiment, as shown in FIGS. 14-16, is adapted to be electrically connected with a plug-type mating terminal 200 and comprises an outer housing ", an inner housing 2", and an elastic terminal 3. The outer housing 1" comprises an outer cylindrical body 11", and an upper blocking disc 12 and a lower blocking disc 14" radially extending inwardly from both ends of the outer cylindrical body 11". The upper blocking disc 12 is provided with an outer through hole 15. The inner housing 2" comprises an inner cylindrical body 21" and a mounting portion 24' surrounding an outer periphery of the inner cylindrical body 21" and integrally formed at the outer periphery of the inner cylindrical body 21". The mounting portion 24' is movably mounted in a space defined by the outer cylindrical body 11", the upper blocking disc 12 and the lower blocking disc 14". The inner housing 2" is formed with an inner through hole 23. The elastic terminal 3 is mounted within the inner cylindrical body 21" and adapted to be electrically connected with the mating terminal 200 inserted into the inner cylindrical body 21" through the outer through hole 15 of the outer housing 1".

The electrical connector 100" of the embodiment shown in FIGS. 14-16 further comprises an elastic mechanism 4 mounted between the outer housing 1" and the inner housing 2". The inner housing 2' is movable relative to the outer housing 1" against an elastic force of the elastic mechanism 4. Since the inner housing 2" is movable relative to the outer housing 1" against the elastic force of the elastic mechanism 4 to allow the mating terminal 200 mounted in the elastic terminal 3 to be movable relative to the outer housing 1" together with the elastic terminal 3, it is possible to achieve a floating electrical connection of the mating terminal 200 with the electrical connector 100".

In an exemplary embodiment, the lower blocking disc 14" shown in FIG. 15 is assembled into a lower end of the outer cylindrical body 11" after the inner housing 21" and the elastic mechanism 4 are assembled into the outer housing 1". The lower blocking disc 14" may be assembled into the lower end of the outer cylindrical body 11" by a connection device such as a screwing connection, a snapping connection and welding, for example.

In the embodiment shown in FIGS. 14 and 15, a stepped portion 17 is formed near a lower end of the outer cylindrical body 1". The stepped portion 17 is adapted to mount the outer cylindrical body 1" into a mounting hole of the circuit board 300. The circuit board 300 with the mounting hole or a copper terminal strip may be mounted on the stepped portion 17 through a soldering or crimping process, and is abutted against a portion of the stepped portion 17 extending radially, thereby firmly mounting the electrical connector 100" on the circuit board 300. Further, the stepped portion 17 has an axially extending portion formed with serrations to further securely mount the electrical connector 100" on the circuit board 300.

It should be appreciated that the electrical connector 100" illustrated in FIGS. 14-16 differs from the electrical connector 100' illustrated in FIGS. 8-13 only in the manner of forming the lower blocking disc 14", and that the elastic terminal 3 and the elastic mechanism 4 of the electrical connector 100" illustrated in FIGS. 14-16 may employ the elastic terminal 3 and the elastic mechanism 4 of the electrical connector 100 shown in FIGS. 1-7.

Figure 17:
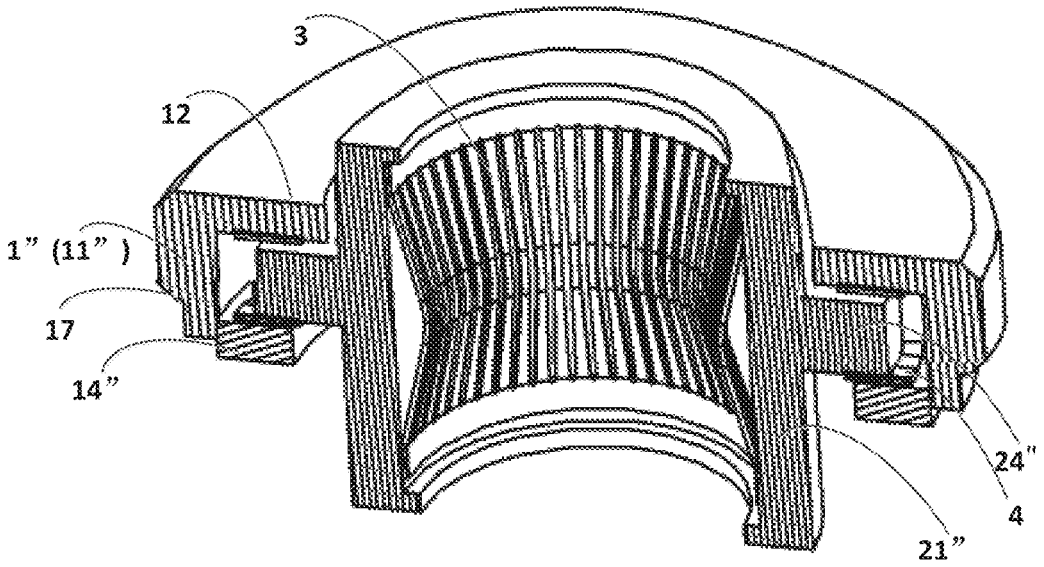
FIG. 17 is a sectional perspective view of an electrical connector according to another embodiment.

An electrical connector according to another embodiment is shown in FIG. 17. The electrical connector of FIG. 17 is a modification of the electrical connector 100" shown in FIGS. 14-16. As shown in FIG. 17, the inner housing comprises an inner cylindrical body 21" and a mounting portion 24" surrounding an outer periphery of the inner cylindrical body 21" and integrally formed at the outer periphery of the inner cylindrical body 21". The mounting portion 24" is movably mounted in a space defined by the outer cylindrical body 11", the upper blocking disc 12, and the lower blocking disc 14" of the outer housing 1". The inner housing is formed with an inner through hole. The elastic terminal 3 is mounted within the inner cylindrical body 21" and adapted to be electrically connected with the mating terminal 200 inserted into the inner cylindrical body 21" through the outer through hole 15 of the outer housing 1". The mounting portion 24" is formed between the upper blocking disc 12 and the lower blocking disc 14", and upper and lower portions of the inner cylindrical body 21" protrude from the upper blocking disc 12 and the lower blocking disc 14", respectively.

In the embodiment shown in FIG. 17, a stepped portion 17 is formed near a lower end of the outer cylindrical body 1". The stepped portion 17 is adapted to mount the outer cylindrical body 1" into a mounting hole of the circuit board. The circuit board with the mounting hole or a copper terminal strip may be mounted on the stepped portion 17 through a soldering or crimping process, and is abutted against a portion of the stepped portion 17 extending radially, thereby firmly mounting the electrical connector on the circuit board. Further, the stepped portion 17 has an axially extending portion formed with serrations to further securely mount the electrical connector on the circuit board. In this way, the inner cylindrical body 21" of the electrical connector passes through the circuit board. Thus, an overall height of an electronic device comprising the circuit board and the electrical connector may be reduced.

According to an exemplary embodiment of another aspect of the disclosure, as shown in FIGS. 2 and 10, there is provided an electronic device including the electrical connectors 100, 100', and 100" as described in any one of the above embodiments, and a circuit board 300 to which the electrical connector 100, 100', 100" is electrically connected. Further, the outer cylindrical body 1, 1', 1" of the electrical connector 100, 100', 100" passes through a mounting hole of the circuit board 300 and is electrically connected with the circuit board 300. In an alternative embodiment, an end face of the upper or lower blocking disk of the electrical connector 100, 100', 100" is soldered to the circuit board 300.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate the embodiments of the disclosure by way of example, and should not be construed as limitation to the disclosure.

Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

It should be noted that, the word "comprise" doesn't exclude other elements or steps, and the word "a" or "an" doesn't exclude more than one. In addition, any reference numerals in the claims should not be interpreted as the limitation to the scope of the disclosure.

What is claimed is:

1. An electrical connector adapted to be electrically connected with a mating terminal, comprising:

an outer housing including an outer cylindrical body, and an upper blocking disc and a lower blocking disc radially extending inwardly from opposite ends of the outer cylindrical body, the upper blocking disc having an outer through hole;

an inner housing including an inner cylindrical body and a mounting portion surrounding an outer periphery of the inner cylindrical body, the inner housing formed with an inner through hole, the mounting portion being movably mounted in a space defined by the outer cylindrical body, the upper blocking disc, and the lower blocking disc; and an elastic terminal mounted within the inner cylindrical body and adapted to be electrically connected with the mating terminal inserted into the inner cylindrical body through the outer through hole and the inner through hole.

2. The electrical connector according to claim 1, further comprising an elastic mechanism mounted between the outer housing and the inner housing.

3. The electrical connector according to claim 2, wherein the lower blocking disc is formed by being bent radially inwardly after the inner housing and the elastic mechanism are assembled into the outer housing.

4. The electrical connector according to claim 2, wherein the lower blocking disc is assembled into a lower end of the outer cylindrical body after the inner housing and the elastic mechanism are assembled into the outer housing.

5. The electrical connector according to claim 2, wherein the outer housing, the elastic terminal, the inner housing, and the elastic mechanism are all made of an electrically conductive material such that the mating terminal is in electrical communication with the outer housing.

6. The electrical connector according to claim 2, wherein a plurality of elastic mechanisms are arranged between the upper blocking disk and the lower blocking disk and between opposite ends of the inner housing, the inner housing is movable relative to the outer housing against an elastic force of the elastic mechanisms in an axial direction.

7. The electrical connector according to claim 6, wherein each of the elastic mechanisms is formed as an annular elastic piece having a wave shape in a circumferential direction.

8. The electrical connector according to claim 1, wherein the inner cylindrical body has a pair of blocking flanges extending radially inwardly at opposite ends of the inner cylindrical body, the inner through hole is defined by the blocking flanges, the elastic terminal includes an elastic cylindrical body formed by winding a single metal sheet, opposite ends of the elastic cylindrical body are confined within the inner cylindrical body by the blocking flanges.

9. The electrical connector according to claim 8, wherein a contact portion protruding radially inwardly is provided between opposite ends of the elastic terminal.

10. The electrical connector according to claim 8, wherein the elastic terminal has a maximum outer diameter larger than an inner diameter of the inner cylindrical body when not mounted within the inner cylindrical body.

11. The electrical connector according to claim 8, wherein a plurality of elastic sheets extending in an axial direction are arranged between the opposite ends of the elastic cylindrical body, a slit is disposed between two adjacent elastic sheets.

12. The electrical connector according to claim 8, wherein a gap is formed between two opposing side edges of the elastic cylindrical body.

13. The electrical connector according to claim 8, wherein a resilient mechanism is provided between the mounting portion and the outer cylindrical body, the inner housing is movable relative to the outer housing against an elastic force of the resilient mechanism in a radial direction.

14. The electrical connector according to claim 1, wherein the inner through hole has an inner diameter smaller than that of the outer through hole, the inner through hole is located within the outer through hole when the inner housing is maximally moved relative to the outer housing in a radial direction.

15. The electrical connector according to claim 1, wherein the outer through hole and the inner through hole are provided respectively at both ends of the outer housing and the inner housing to allow the mating terminal to be inserted into and pass through the electrical connector.

16. The electrical connector according to claim 1, wherein the mounting portion has a same height as the inner cylindrical body.

17. The electrical connector according to claim 16, wherein the upper blocking disk extends radially outwardly to form a flange portion.

18. The electrical connector according to claim 17, wherein a portion of the outer cylindrical body adjacent to the flange portion is formed as a widened portion protruding radially outwardly.

19. The electrical connector according to claim 18, wherein the widened portion has a plurality of serrations.

20. The electrical connector according to claim 1, wherein the mounting portion has a height less than that of the inner cylindrical body and at least a portion of the inner cylindrical body protrudes from at least one of the upper blocking disc and the lower blocking disc.

21. The electrical connector according to claim 20, wherein the mounting portion is formed adjacent to the upper blocking disk and at least a portion of the inner cylindrical body extends from the lower blocking disk.

22. The electrical connector according to claim 20, wherein the mounting portion is formed between the upper blocking disc and the lower blocking disc, and an upper and a lower portion of the inner cylindrical body protrude from the upper blocking disc and the lower blocking disc, respectively.

23. The electrical connector according to claim 21, wherein a stepped portion is formed near a lower end of the outer cylindrical body, the stepped portion being adapted to mount the outer housing into a mounting hole of a circuit board.

24. An electronic device, comprising:

an electrical connector including:

an outer housing including an outer cylindrical body, and an upper blocking disc and a lower blocking disc radially extending inwardly from opposite ends of the outer cylindrical body, the upper blocking disc having an outer through hole, an inner housing including an inner cylindrical body and a mounting portion surrounding an outer periphery of the inner cylindrical body, the inner housing formed with an inner through hole, the mounting portion being movably mounted in a space defined by the outer cylindrical body, the upper blocking disc, and the lower blocking disc; and an elastic terminal mounted within the inner cylindrical body and adapted to be electrically connected with the mating terminal inserted into the inner cylindrical body through the outer through hole and the inner through hole; and a circuit board to which the electrical connector is electrically connected.

* * * * *